US008104837B2

(12) United States Patent
Diffrient

(10) Patent No.: US 8,104,837 B2
(45) Date of Patent: Jan. 31, 2012

(54) ERGONOMIC CHAIR ARM

(75) Inventor: Niels Diffrient, Ridgefield, CT (US)

(73) Assignee: Humanscale Corporation, New York, NY (US)

( * ) Notice: Subject to any disclaimer, the term of this patent is extended or adjusted under 35 U.S.C. 154(b) by 351 days.

(21) Appl. No.: 12/173,952

(22) Filed: Jul. 16, 2008

(65) Prior Publication Data

US 2009/0015053 A1 Jan. 15, 2009

Related U.S. Application Data

(62) Division of application No. 11/173,874, filed on Jul. 1, 2005, now Pat. No. 7,581,791.

(60) Provisional application No. 60/586,114, filed on Jul. 7, 2004.

(51) Int. Cl.
*A47C 7/54* (2006.01)

(52) U.S. Cl. ..... 297/411.31; 297/411.32; 297/411.37; 297/411.38

(58) Field of Classification Search ..... 297/411.31, 297/411.32, 411.37, 411.38
See application file for complete search history.

(56) References Cited

U.S. PATENT DOCUMENTS

| | | | | |
|---|---|---|---|---|
| 213,775 | A | | 4/1879 | Redman et al. |
| 274,223 | A | | 3/1883 | Redman |
| 1,050,672 | A | | 1/1913 | MacIntosh |
| 1,139,581 | A | | 5/1915 | Riley |
| 4,244,623 | A | | 1/1981 | Hall et al. |
| 4,307,913 | A | | 12/1981 | Spiegelhoff |
| 4,311,338 | A | | 1/1982 | Moorhouse |
| 4,946,226 | A | * | 8/1990 | Hurn et al. ..... 297/411.38 X |
| 6,176,550 | B1 | | 1/2001 | Lamart et al. |
| 6,619,746 | B2 | | 9/2003 | Roslund, Jr. et al. |
| 6,702,386 | B2 | | 3/2004 | Davis et al. |
| 6,709,058 | B1 | | 3/2004 | Diffrient |
| 6,959,965 | B2 | | 11/2005 | Diffrient |
| 2002/0149024 | A1 | | 10/2002 | Kato et al. |
| 2003/0030317 | A1 | | 2/2003 | Chen |
| 2006/0006723 | A1 | | 1/2006 | Diffrient |

FOREIGN PATENT DOCUMENTS

| | | | |
|---|---|---|---|
| EP | 1057428 | A1 | 12/2000 |
| WO | 03/068025 | A2 | 8/2003 |
| WO | 2006/017065 | A3 | 2/2006 |

OTHER PUBLICATIONS

International Preliminary Report on Patentability on PCT/US2005/023768 issued by the European Patent Office as International Preliminary Examining Authority on Mar. 2, 2007.
PCT/US05/023768: EPO as International Search Authority, written opinion issued Jan. 7, 2007.

* cited by examiner

*Primary Examiner* — Anthony D Barfield
(74) *Attorney, Agent, or Firm* — Jones, Walker, Waechter, Poitevent, Carrere & Denegre, LLP

(57) ABSTRACT

The invention provides a chair armrest that is variably adjustable to allow a user to assume an ergonomically preferred sitting position. The ergonomic chair armrest comprises, either separately or together, an arm support assembly capable of adjustment to various positions through a vertical plane and an arm pad assembly capable of adjustment to various positions through a horizontal plane. The invention further provides an ergonomic chair having an armrest that is adjustable in both a vertical plane and a horizontal plane.

20 Claims, 16 Drawing Sheets

ERGONOMIC CHAIR ARM

CROSS-REFERENCE TO RELATED APPLICATION

This application is a divisional application for patent claiming the benefit of the earlier filed non-provisional application for U.S. patent application Ser. No. 11/173,874 filed on Jul. 1, 2005 now U.S. Pat. No. 7,581,791 and incorporated herein by reference, which claims the benefit of provisional application for patent application Ser. No. 60/586,114 filed on Jul. 7, 2004 and incorporated herein by reference.

FIELD OF THE INVENTION

The present invention is generally related to a chair armrest that is variably adjustable to allow a user to assume an ergonomically preferred sitting position, and to chairs incorporating such an armrest. In a particular embodiment, the invention is related to a chair armrest that quickly and easily adjusts in a substantially vertical plane to a variety of heights. In another embodiment, the invention is related to a chair armrest that quickly and easily adjusts in a substantially horizontal plane to a variety of positions closer to or further away from a user's body.

BACKGROUND

Armrests for chairs, particularly office chairs, are known in the art. Early armrests were generally stationary, i.e., they were affixed to the chair in a position that was essentially non-moveable, either horizontally or vertically, in relation to the seated user. While chairs with such armrests are still common, it has been realized that, particularly in respect to office chairs, chairs with armrests capable of movement (either horizontally, vertically, or both) are more readily adaptable to a multitude of different users.

One example of an adjustable armrest is provided in U.S. Pat. No. 6,619,746 to Rosland, Jr. et al., which describes a height adjustable and rotatable chair arm for an office chair. The chair arm includes an arm assembly supported on a rotatable sleeve mounted on an upright support post, wherein rotation of the sleeve relative to the support post allows for rotation of the arm assembly. The sleeve further includes a vertical set of slots for receiving a portion of a lock mechanism located on the arm assembly. The sleeve can thus be moved vertically on the support post, the position maintained by the lock mechanism.

Similarly, U.S. Pat. No. 6,702,386 to Davis et al. describes a height and pivot-adjustable office chair arm assembly. The arm rest can be raised to different vertical positions by actuation of a gas cylinder surrounded by a shroud. The armrest is also capable of achieving multiple rotational positions by pivoting in a horizontal plane with a pivot support attached to the shroud.

While the ability to achieve multiple armrest positions is beneficial, it has recently been observed that with the increasing amount of time spent by a large number of people in performing office work, it is desirable, particularly for health maintenance, to provide office equipment, such as office chairs, that are ergonomically advanced. An example of the recognition of such need is U.S. Pat. No. 6,709,058 to Different, which is hereby incorporated herein by reference in its entirety. The Different patent describes an ergonomic chair that includes an adjustable armrest capable of being readily raised, or lowered, and optionally rotated in a horizontal plane.

While armrests capable of horizontal and vertical adjustment are known, there remains a need in the art for an ergonomic chair armrest capable of variable positioning by multiple users to provide the most ergonomically beneficial position possible. Further, there remains a need in the art for chairs incorporating such armrests.

Accordingly, the present invention provides an ergonomic chair armrest capable of vertical position adjustment, horizontal position adjustment, or both, allowing a variety of different users to achieve a most ergonomically desirable arm support.

SUMMARY OF THE INVENTION

According to one embodiment of the present invention, there is provided an ergonomic chair armrest having an arm support assembly capable of adjustment to various positions through a vertical plane.

The present invention includes another embodiment wherein there is provided an ergonomic chair armrest having an arm pad assembly capable of adjustment to various positions through a horizontal plane.

According to yet another embodiment of the present invention, there is provided an ergonomic office chair having an armrest that is adjustable, in both a horizontal plane and a vertical plane, to allow a variety of different users to achieve ergonomically favorable arm support while in a sitting position.

The arm support assembly uses two bars in a parallel linkage, each bar having an angled back portion that is pivotally attached to an arm mount, which facilitates attachment of the arm support assembly to a chair. Preferentially, the arm mount is adaptable for attachment to the back portion, or any other suitable part, of a chair. The two bars each also comprise front sections having ratcheted ends that simultaneously engage a slidably disengageable lock plate. The lock plate is disengaged through actuation of an aim lock release button at a free end of the arm support assembly. Actuation of the button pulls an attached tension wire in a direction 180° opposite the locking mechanism. An opposite end of the tension wire has a portion angled at approximately 90° that slidably engages the lock plate, disengaging the lock plate from the ratcheted ends of the bars. Actuation of the button also disengages a stop bar from a stop nose (which is attached to the lock plate), said disengagement taking place prior to disengagement of the lock plate from the ratcheted ends of the bars.

The arm pad assembly is comprised of an arm pad pan that is capable of being moveably anchored to a chair arm and that is designed for receiving the components for facilitating movement of the arm pad assembly. The components of the arm pad assembly are comprised of two moveable links pinned together in a sliding junction. The two links are pivotally pinned to the arm pad pan on either side of the point where the two links are pinned together. The ends of the two links opposite the sliding junction are bolted to an arm support through a front slot track and a rear slot track, allowing the opposite ends of the two links to move through said slot tracks. The front slot track has an overall length that is greater than the rear slot track facilitating an overall movement of the arm pad assembly that is at least somewhat arcuate in nature.

The arm pad assembly further comprises a link locking mechanism that engages the slidable end of the front link thereby locking the arm pad into position. The link locking mechanism is biased into a locked position, generally with an inner spring mechanism, and can be actuated out of the locked position allowing adjustment of the position of the arm pad assembly. Such actuation is preferably achieved with an arm actuating crank that is pivotally attached at one end to the lock slide mechanism and is pivotally attached at another end to a release mechanism, such as a push button. At some point in between said ends, the arm actuator crank is pivotally attached to the arm pad pan. According to this structure, pushing the push button actuates the link locking mechanism such that it is disengaged from the slidable end of the front link. A user is then able to manually position the arm pad assembly into an ergonomically beneficial position prior to releasing the push button and allowing the lock mechanism to be biased back into the locked position, again engaging the slidable end of the front link.

The arm pad assembly further comprises a series of holes for attaching a ring mechanism having a lip for receiving a covering for the arm pad assembly. After attachment of the ring, any number of different styles of arm pad coverings can be attached and removed at the manufacturing stage or by the end user. The arm pad covering not only hides and protects the working parts of the arm pad assembly but also provides an optimal cushioning effect for the user.

DETAILED DESCRIPTION OF THE INVENTION

The present invention will now be described more fully hereinafter with reference to the accompanying drawings, in which some, but not all embodiments of the invention are shown. The present invention may be embodied in many different forms and should not be construed as limited to the embodiments set forth herein; rather, these embodiments are provided so that this disclosure will satisfy applicable legal requirements. Like numbers refer to like elements throughout.

The present invention is a positionally adjustable chair arm assembly, and chairs, particularly office chairs, including such an assembly. In one embodiment, the chair arm assembly comprises an arm support assembly capable of adjustment through a vertical plane for customizing chair arm height to the user's preference and comfort. In another embodiment, the chair arm assembly comprises an arm pad assembly capable of adjustment through a horizontal plane for customizing the position of the chair arm in relation to the user's body (i.e., either closer to, or further away from, the user). In another embodiment, the chair arm assembly comprises both the arm support assembly and the arm pad assembly. In each of the various embodiments of the invention, the chair arm assembly is beneficially arranged for facilitating a most ergonomically desirable arm positioning for a number of various users.

Figure 1:
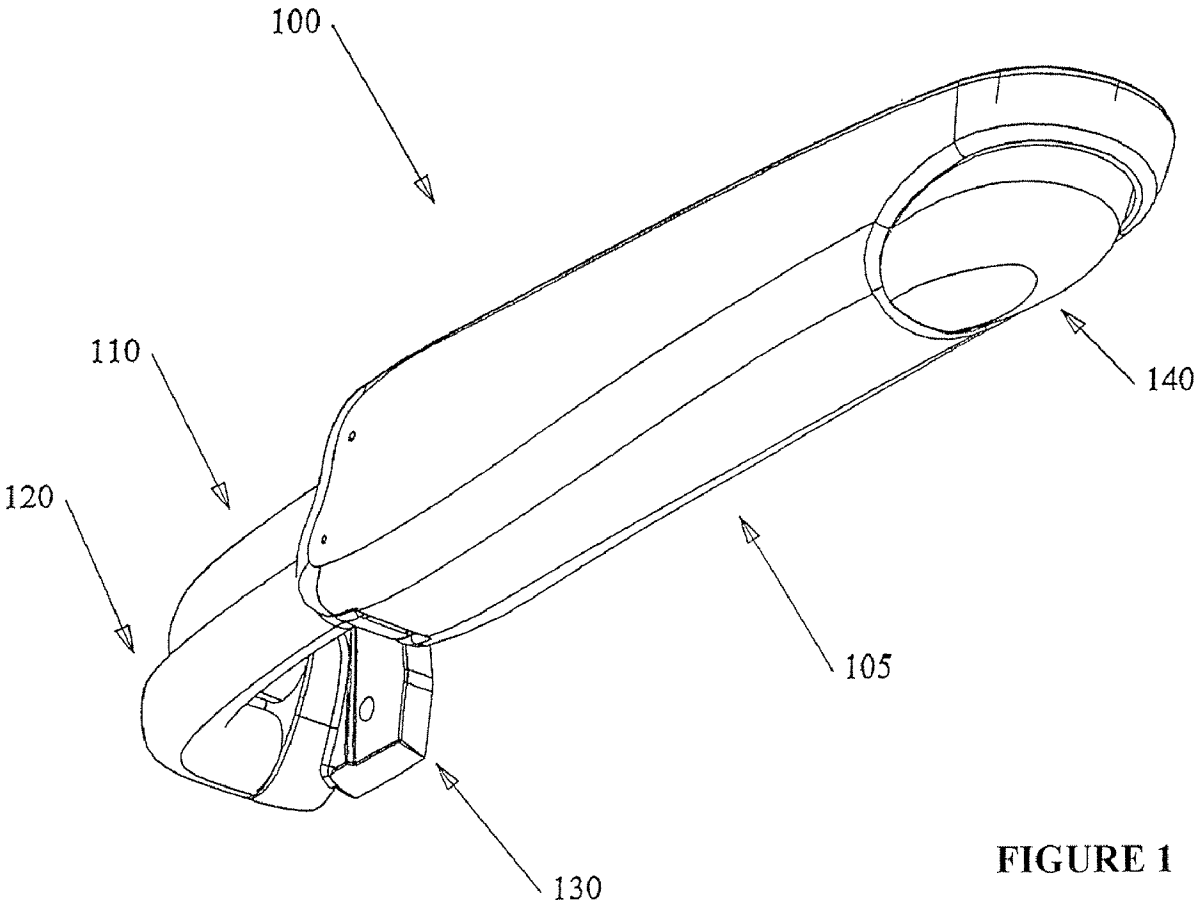
FIG. 1 is a bottom perspective view of one embodiment of the arm support assembly according to the invention.

FIG. 1 provides a perspective view of one embodiment of the arm support assembly 100 of the invention. According to this embodiment, the arm support assembly 100 generally comprises an upper bar 110 and a lower bar 120, which are preferentially aligned in a parallel linkage. Each of the upper bar 110 and the lower bar 120, in one embodiment, have an angled back portion for attachment to an arm mount 130. The arm mount 130 can then be attached to a chair, such as an office chair.

Preferentially, the arm mount is adaptable for attachment to the back portion of a chair; however, other attachments are also envisioned by the present invention. For example, a chair incorporating the arm support of the present invention could further comprise an additional support assembly particularly adapted for attachment of the arm support of the present invention. Such a support assembly would be particularly useful in a chair embodiment having a tiltable back portion.

The arm support assembly 100, as shown in FIG. 1, is for use as a right arm when attached to a chair. Accordingly, it is readily envisioned that a left arm could also be described according to the present description, and it would be expected that a left arm support assembly would be substantially a mirror image of the right arm support assembly 100 as shown in FIG. 1.

According to the present invention, it is generally preferred that the upper bar 110 and the lower bar 120 are of substantially identical lengths. Preferentially, the length of the upper bar 110 and the lower bar 120, when measured from the angular back portion to the front portion of each bar, is about 4 inches to about 8 inches. More preferably, the upper bar 110 and the lower bar 120 are each about 6 inches in length.

The incorporation of the arm mount 130 in the arm support assembly 100 allows for vertical adjustment of the arm support assembly 100 independently. In other words, a chair having two arms according to the present invention would be capable of adjustment of the arm height of one arm independently of the other arm.

The arm support assembly 100 further comprises an arm lock release button 140 for temporarily disengaging a locking mechanism that is incorporated in the arm support assembly 100 and is useful for maintaining the selected height of the arm support assembly 100. The locking mechanism is not visible in FIG. 1, as it is within the arm support covering 105.

Figure 2:
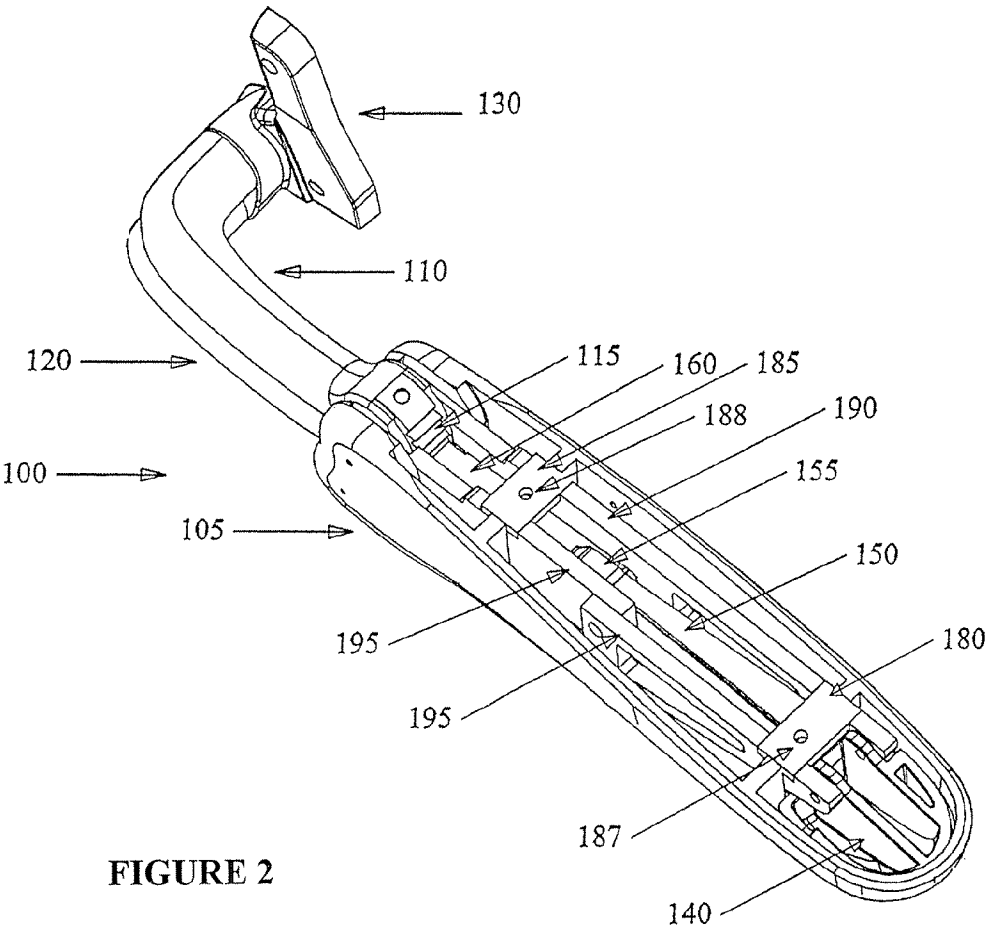
FIG. 2 is a top perspective view of one embodiment of the arm support assembly according to the invention.
Figure 3:
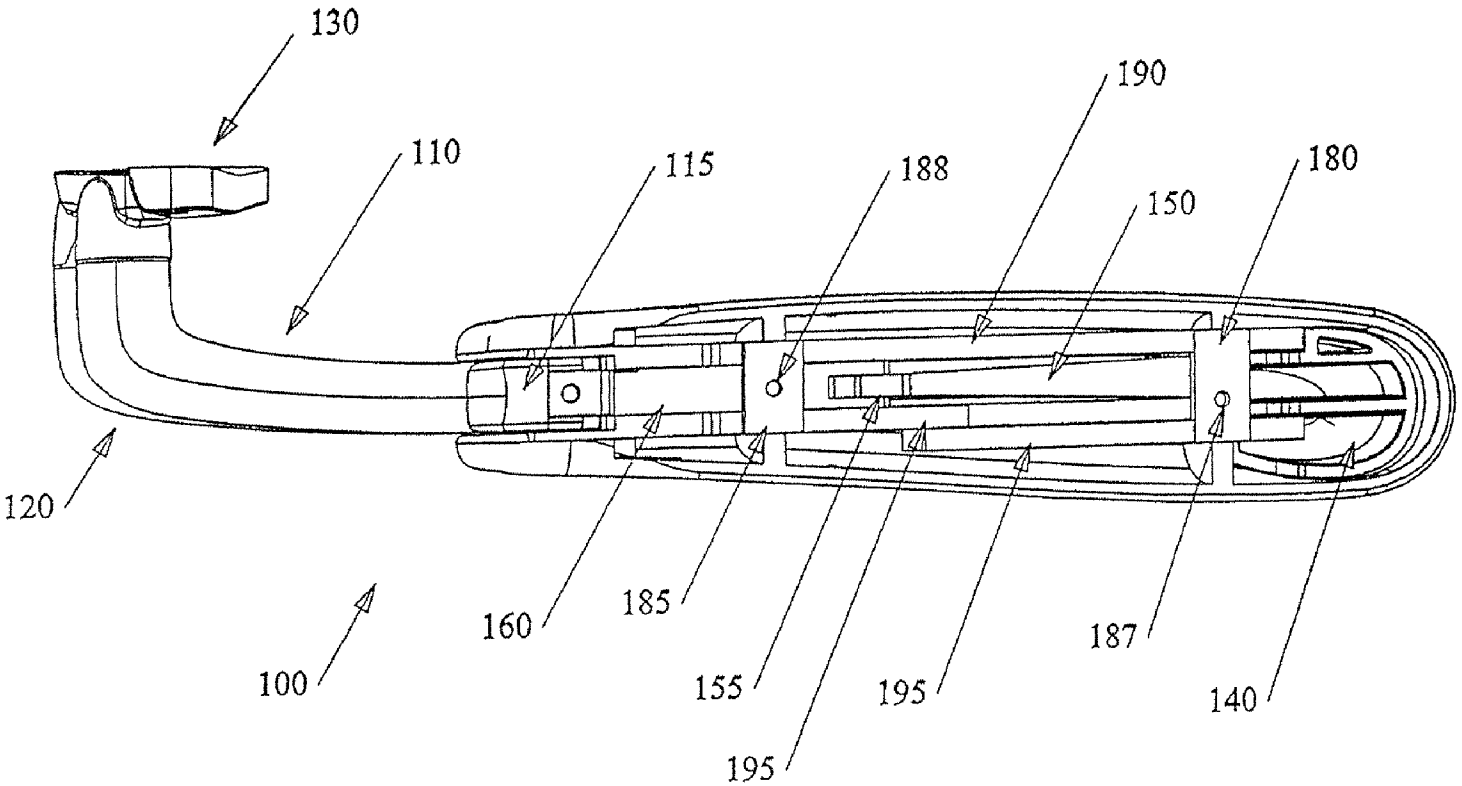
FIG. 3 is a top view of one embodiment of the arm support assembly according to the invention.

One embodiment of the arm support assembly 100 is illustrated in more detail in FIG. 2, which provides a top perspective view, and in FIG. 3, which provides a top view, of the arm support assembly 100. As seen in these views, the upper bar 110 terminates at its front end with an upper ratchet 115. Similarly, the lower bar 120 terminates at its front end with a lower ratchet 125 (not visible in these views). While the embodiment shown in FIG. 2 and FIG. 3 illustrates ratcheted ends for the upper and lower bars, the present invention also encompasses further embodiments. In general, any type of arrangement capable of engaging an arm lock assembly and thereby maintaining the arm at a given height would be useful according to the invention. For example, other types of toothed wheel or gear-type arrangements could be used for engaging an arm lock assembly according to the invention.

The invention, therefore, further includes an arm lock assembly for interacting with the ratchets, or other similar mechanisms, as described above. The arm lock assembly can be any device having ends formed for interacting with the ratcheted arm ends (i.e., for engaging the upper bar 110 and the lower bar 120). Such interaction should be some type of stable connection such that when the arm lock assembly is interacting with the ratchets and engaging the upper and lower arm bars, the arm height is maintained, even under force, such as the weight of the arms of a user on the chair arm.

In one embodiment of the invention, the arm lock assembly is a lock plate having two projections formed and arranged for interacting with the ratchets on the upper and lower arms. Accordingly, in one embodiment, the arm support assembly 100 includes a lock plate 160, which slidably engages each of the upper ratchet 115 and the lower ratchet 125 simultaneously, locking the arm support assembly 100 at its particular height. The top, front portion of the lock plate 160 comprises a projection (stop nose 155), which is in substantial physical connection with a stop bar 150. In turn, the stop bar 150 is attached to the arm release button 140.

The arm support assembly 100 further comprises a frame assembly, which includes an inside frame plate 190, an outside frame plate 195 (which is comprised of two pieces), a front frame block 180, a rear frame block 185, and a connector block 175 (not visible in these views). Additionally, the front frame block 180 includes a front pad assembly attachment aperture 187, and the rear frame block 185 includes a rear pad assembly attachment aperture 188. The arm release button 140 is pivotally attached to at least one of inside frame plate 190 and outside frame plate 195.

According to one embodiment of the invention, the arm support assembly 100 is capable of vertical adjustment to a number of different heights. Preferentially, the arm support assembly 100 is capable of adjustment to a maximum height where it can provide arm support even for users substantially taller than the average individual. Further, preferentially, the arm support assembly 100 is capable of adjustment to an extreme lowered position where it is substantially out of the usable range as an arm support. This extreme lowered position allows a chair comprising the arm support assembly 100 to function substantially as if no arms rests were included on the chair. Such function could be advantageous, such as when a user is performing an unusual amount of side-to-side work and the presence of arm rests is cumbersome, or when a chair needs to be pushed up under a desk or table, and the presence of arm rests at a normal height would prevent such positioning.

Figure 4:
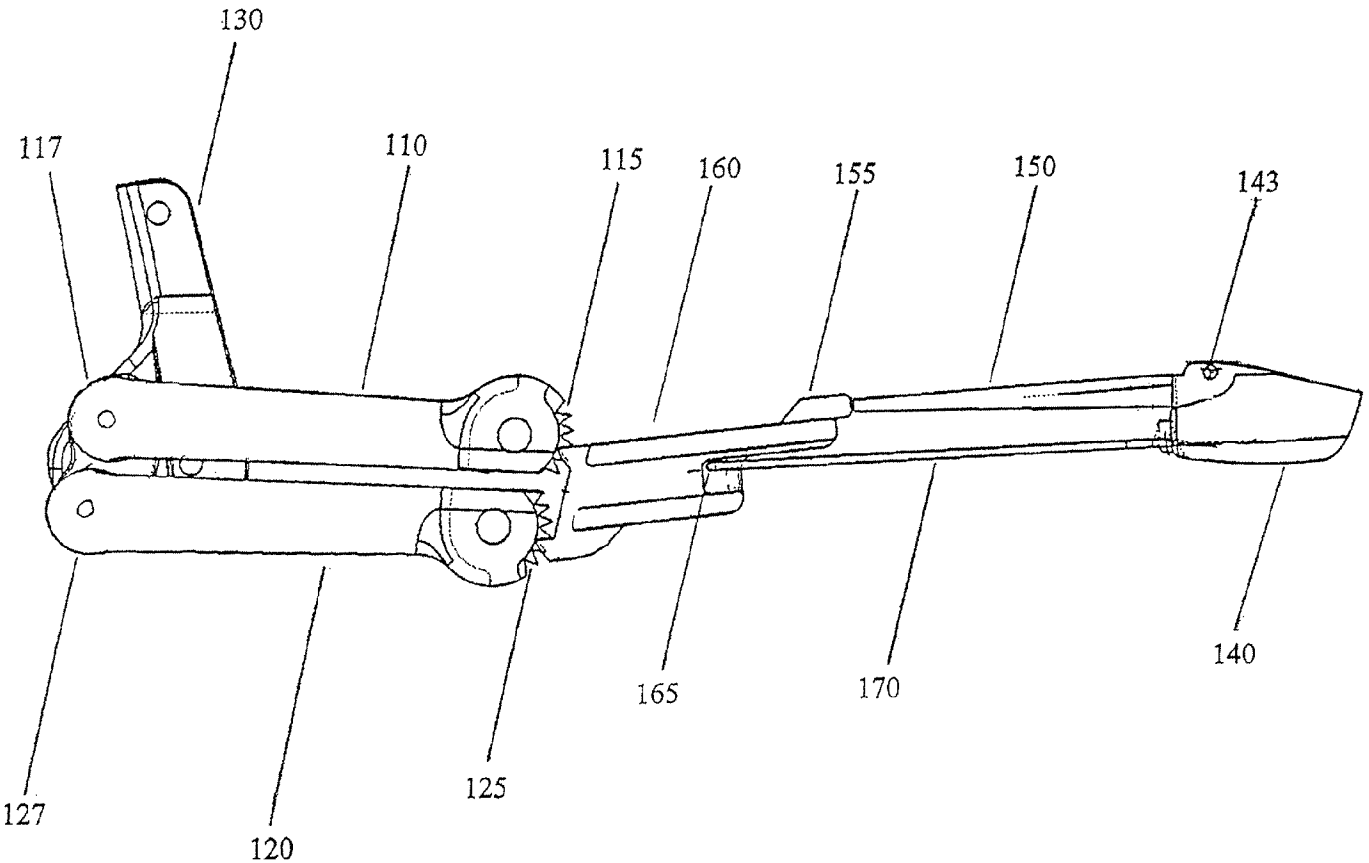
FIG. 4 is a side view of one embodiment of the arm support assembly according to the invention with the casing and frame components removed and the lock mechanism engaged in an intermediate position.
Figure 5:
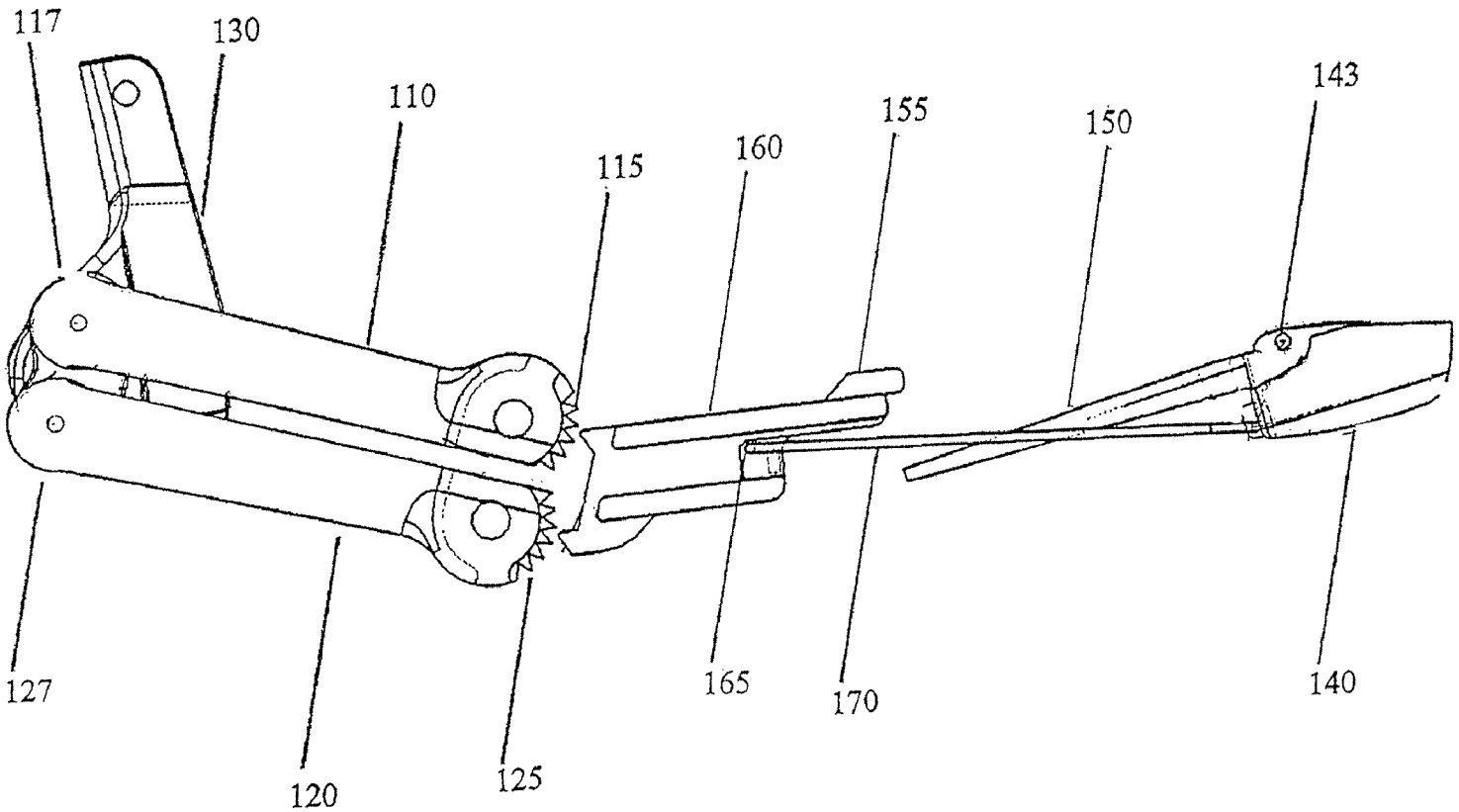
FIG. 5 is a side view of one embodiment of the arm support assembly according to the invention with the casing and frame components removed and the lock mechanism disengaged.
Figure 6:
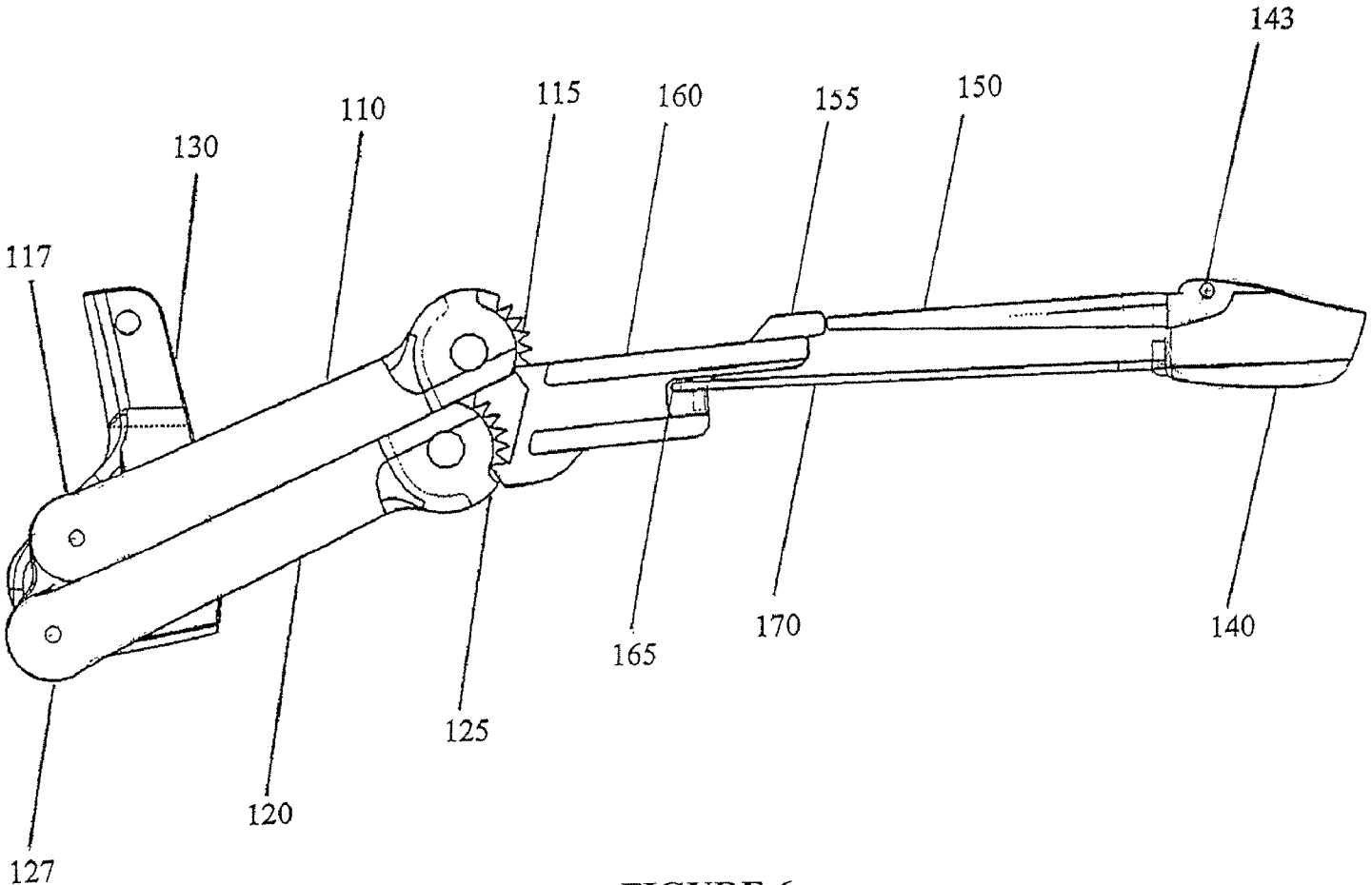
FIG. 6 is a side view of one embodiment of the arm support assembly according to the invention with the casing and frame components removed and the lock mechanism engaged in a raised position.

As further illustrated in FIGS. 4-6, the arm support assembly 100 can be adjusted in a vertical plane. In FIG. 4, the arm support assembly 100 is in an intermediate position, being between an extreme raised position and an extreme lowered position. In such an intermediate position, the upper bar 110 and the lower bar 120, being in a parallel linkage, remain separated. The arm support assembly 100 is in a locked position, i.e., the upper ratchet 115 and the lower ratchet 125 are engaged by the lock plate 160. The engagement of the lock plate 160 with the upper ratchet 115 and the lower ratchet 125 is further maintained by the stop bar 150, which is in substantial physical connection with the stop nose 155, which in turn is physically attached to the lock plate 160. Being in substantial physical connection with the stop nose 155, the stop bar 150 is thus touching or substantially close to touching the stop nose 155 such that any forward movement of the stop plate 160 would cause actual physical connection of the stop nose 155 with the stop bar 150 prior to disengagement of the lock plate 160 with the upper ratchet 115 and the lower ratchet 125. As such, the lock plate 160 cannot move forward (i.e., cannot disengage the upper ratchet 115 and the lower ratchet 125) unless the stop bar 150 is first moved out of substantial physical connection with the stop nose 155.

Movement of both the stop bar 150 and the lock plate 160 is effected through actuation of the arm release button 140. When the arm release button 140 is pressed upward, it first releases the stop bar 150 from the locking position and then begins to move the lock plate 160 out of engagement with the upper ratchet 115 and the lower ratchet 125. The construction of the arm support assembly 100 that allows for such movement is more closely illustrated in FIG. 4*a* and FIG. 4*b*.

Figure 4A:
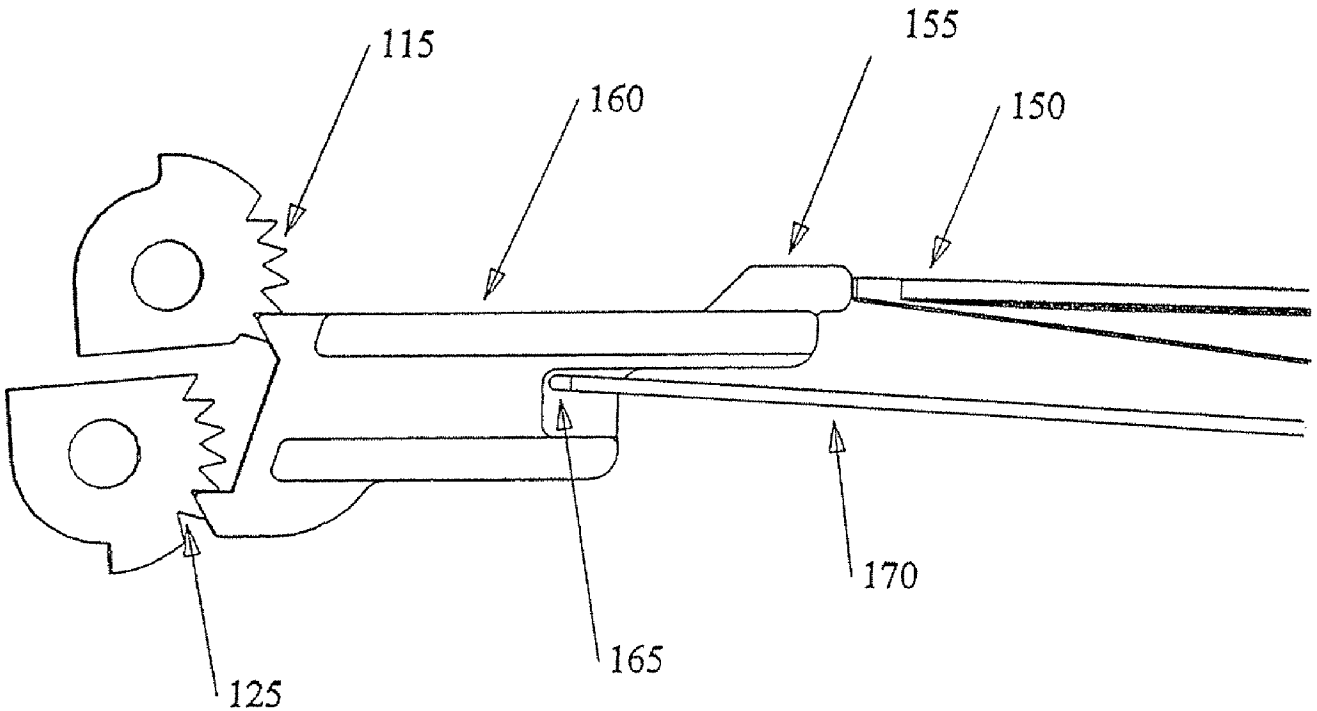
FIG. 4*a* is an enlarged partial side view of the lock plate component of the arm support assembly according to the invention.
Figure 4B:
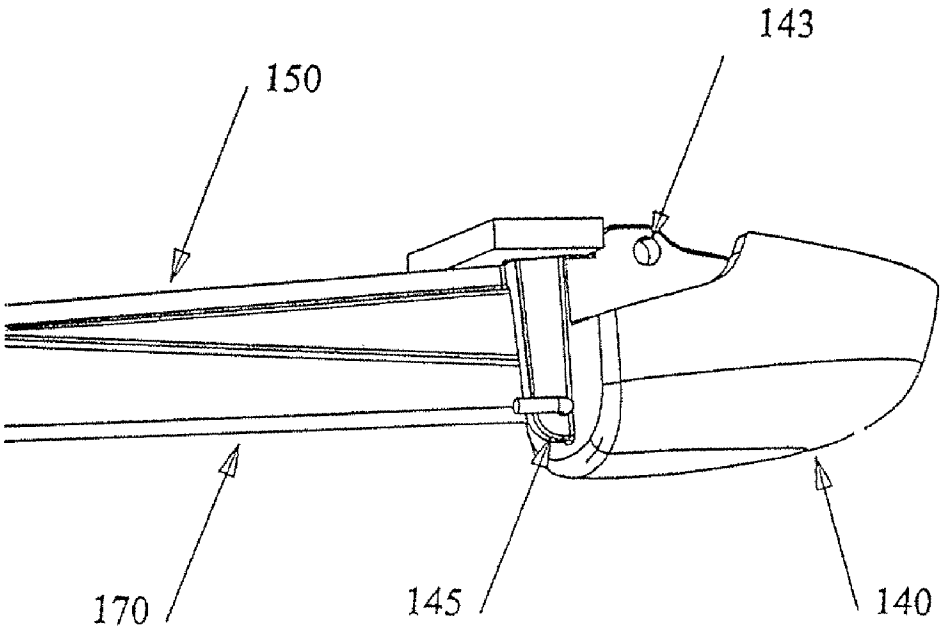
FIG. 4*b* is an enlarged partial side perspective view of the arm release button of the arm support assembly according to the invention.

As shown in FIG. 4*b*, the arm release button 140 and the stop bar 150 are physically attached. In one preferred embodiment, the arm release button 140 and the stop bar 150 are one continuous piece. The arm release button 140 is pivotally attached to the arm support assembly frame at button pivot 143. As shown in the embodiment of FIG. 5, when the arm release button 140 is pressed upward, it pivots at button pivot 143. The stop bar 150, being physically attached to the arm release button 140, also pivots at the button pivot 143, but in a downward direction, thus being moved out of substantial contact with the stop nose 155. In this manner, the arm release button 140 is attached to the stop bar 150 such that actuation of the arm release button causes the stop bar 150 to be moved out of substantial connection with the stop nose 155, and thus lock plate 160, to which the stop nose 155 is attached.

Once the stop bar 150 is moved away from the stop nose 155, the lock plate 160 is free to be moved out of engagement with the upper ratchet 115 and the lower ratchet 125. To facilitate such movement, the arm support assembly 100 preferably includes a motion-inducing component. The motion-inducing component can be any mechanism capable of attachment at one end to the arm release button and at the other end to the lock assembly. Accordingly, the motion-inducing component is used for disengaging the lock assembly from the upper ratchet and the lower ratchet by causing the lock assembly to move out of engagement with the ratchets.

In one embodiment of the invention, the motion-inducing component is a pull wire. The pull wire preferably comprises some type of metal that is capable of being formed to various curved shapes or angles at the ends thereof, that provides sufficient strength for maintaining such shapes or angles and for moving the lock assembly away from the ratchets, and that provides durability for long-term use.

The arm release button 140 preferably comprises a button flange 145, to which a pull wire 170 can be connected. In one embodiment, the pull wire 170 is substantially U-shaped at the forward end for insertion into a receiving hole in the button flange 145. In another embodiment, the pull wire 170 is substantially L-shaped at the forward end. Preferentially, the diameter of the receiving hole in the button flange 145 is approximately equivalent to the diameter of the pull wire 170, thereby reducing any "play" in the interaction between the pull wire 170 and the button flange 145. Accordingly, any forward movement of the pull wire 170 would essentially simultaneously correspond to any forward movement of the button flange 145. Other methods of connecting the pull wire 170 to the button flange 145 would also be encompassed by the invention.

The rearward end of the pull wire 170 runs along one side of the lock plate 160 and is angled at approximately 90° for insertion into a wire aperture 165 in the lock plate 160. As can be seen in FIG. 4*a*, the wire aperture 165 is substantially oblong. Accordingly, the wire aperture 165 could be described as having two axes, a long axis and a short axis. In a preferred embodiment, the short axis of the wire aperture 165 is a vertical axis and is substantially similar in diameter to the diameter of the pull wire 170. Also according to a preferred embodiment, the long axis of the wire aperture 165 is a horizontal axis and is greater in diameter than the diameter of the pull wire 170. Accordingly, when the arm support assembly 100 is in a locked position (i.e., the lock plate 160 is engaging the upper ratchet 115 and the lower ratchet 125), the pull wire 170 is at rest substantially close to the rearward end of the wire aperture 165, which is oblong along the horizontal axis.

The oblong nature of the wire aperture 165 allows time for movement of the stop bar 150 out of its substantial contact with the stop nose 155 prior to engagement of the pull wire 170 with the forward end of the wire aperture 165 and the movement of the lock plate 160 out of engagement with the upper ratchet 115 and the lower ratchet 125.

When the arm release button 140 is pressed upward, the movement of the release button 140 also effects the forward movement of the pull wire 170, which is connected at its forward end to the button flange 145 and at its rearward end to the lock plate 160. Movement of the pull wire 170 does not, however, effectuate immediate movement of the lock plate 160 because of the oblong shape of the wire aperture 165. Thus, although the pull wire 170 is moving forward, it does not immediately begin interaction with the lock plate 160. Accordingly, the stop bar 150 is provided time to move out of its substantial contact with the stop nose 155 before the pull wire 170 makes contact with the forward end of the wire aperture 165 and begins pulling the lock plate 160 out of engagement with the upper ratchet 115 and the lower ratchet 125. In this manner, the lock plate 160 is slidably attached to the arm release button 140, such that actuation of the arm release button 140 disengages the lock plate from the upper ratchet 115 and the lower ratchet 125.

FIG. 5 illustrates one embodiment of the invention, wherein the arm support assembly 100 is in the unlocked position, the lock plate 160 being disengaged from the upper ratchet 115 and the lower ratchet 125. Further illustrated in FIG. 5, the stop button 140 is pivoted into an upward, activating position, and the stop bar 150 is similarly pivoted downward into an inactive position, being out of substantial contact with the stop nose 155. The inactive state of the stop bar 150 allows the lock plate 160 to be in a forward, disengaged position, having been pulled there by the pull wire 170. Accordingly, the lock plate 160 is disengaged from the upper ratchet 115 and the lower ratchet 125, and the arm support assembly 100 is capable of manual adjustment by a user, the upper bar 110 pivoting at an upper bar pivot 117 and the lower bar 120 pivoting at a lower bar pivot 127.

FIG. 6 illustrates an embodiment of the invention wherein the arm support assembly 100 has been adjusted to a higher vertical position. The arm release button 140 has resumed its neutral, inactive position. Accordingly, the forward pulling motion of the pull wire 170 on the lock plate 160 has ceased, and the lock plate 160 has moved back into its active position, engaging the upper ratchet 115 and the lower ratchet 125. In a preferred embodiment, the lock plate 160 is biased into the active position, such as with an internal spring providing tension rearward toward the upper ratchet 115 and the lower ratchet 125. Other methods for encouraging the lock plate 160 into the position engaging the upper ratchet 115 and the lower ratchet 125 are also envisioned by the present invention. Also shown in FIG. 6, the stop bar 150 has resumed its position of substantial contact with the stop nose 155.

Figure 7:
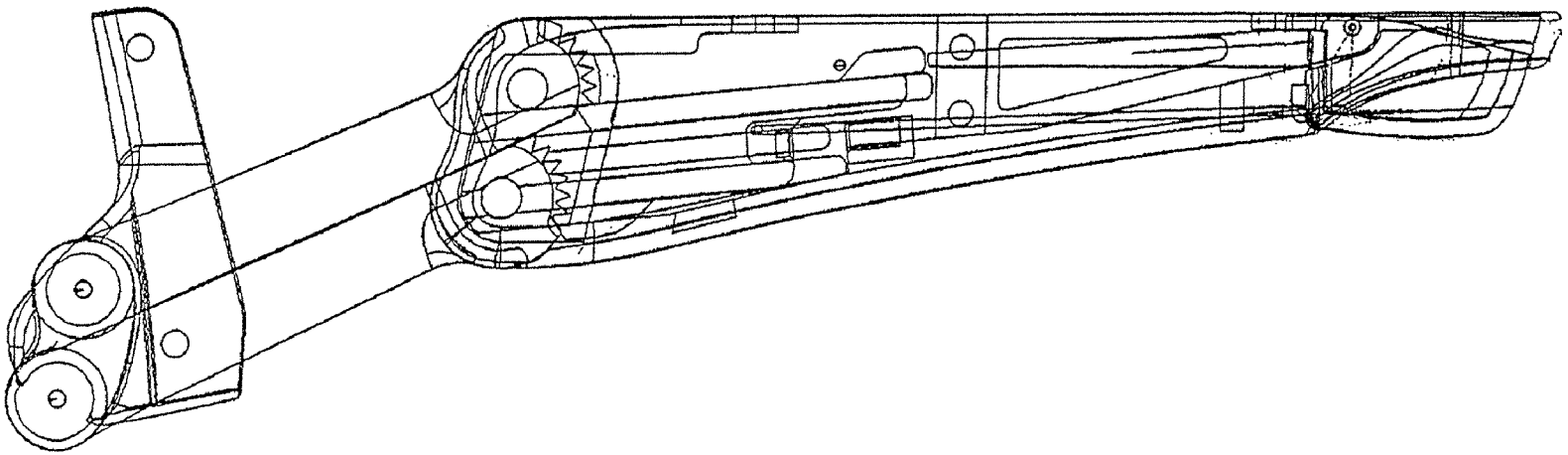
FIG. 7 is a side view of one embodiment of the arm support assembly according to the invention with the casing and frame components transparent to reveal the inner components.

Another side view of an arm support assembly embodiment according to the invention is provided in FIG. 7, which includes all component parts of the arm support assembly 100, but provides the arm casing and arm frame members as partially transparent to reveal the inner components as well.

Figure 8:
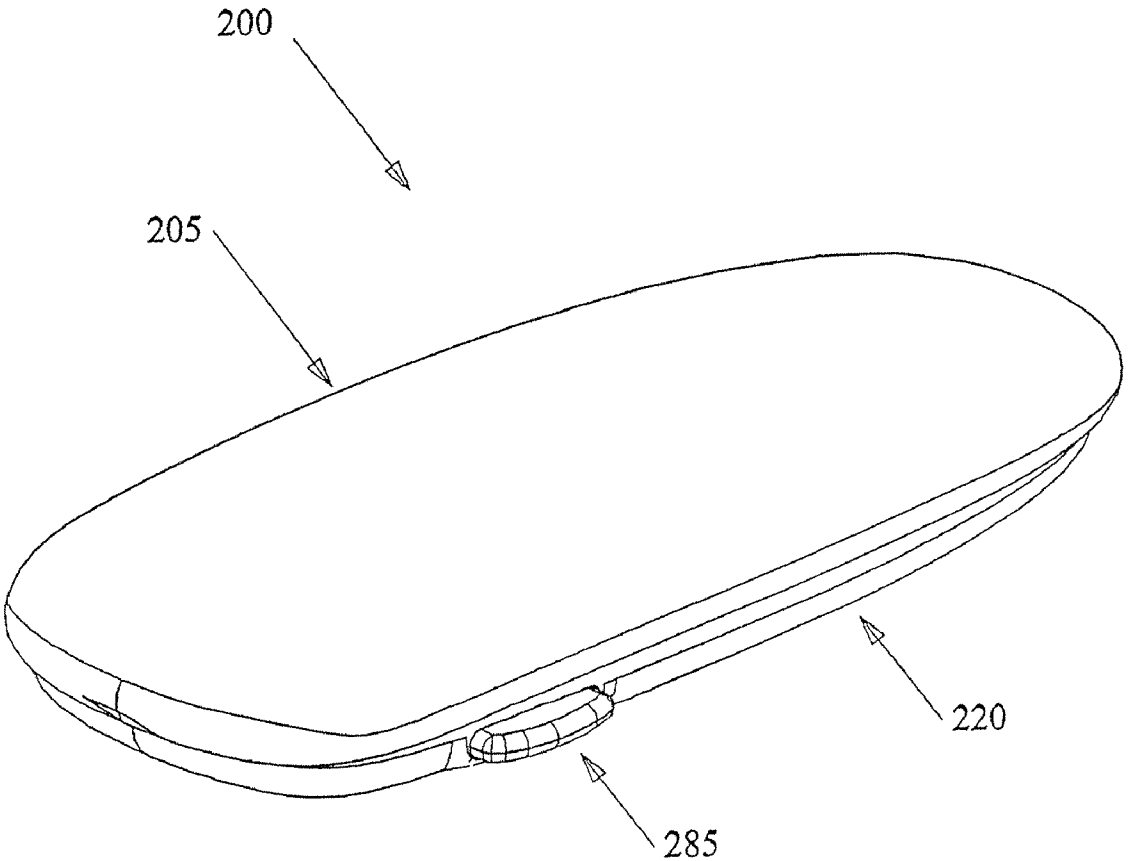
FIG. 8 is a top perspective view of one embodiment of the arm pad assembly according to the invention with the arm pad covering in place.

According to another embodiment of the invention, there is provided an arm pad assembly, as illustrated in FIG. 8, which shows a top perspective view of the arm pad assembly 200 in a finished state. Seen in this view are an arm pad covering 205, an arm pad pan 220, and a link lock release button 285. The arm pad pan 220 contains the working components of the arm pad assembly 200. Actuation of the link lock release button 285 frees the arm pad assembly for manual side-to-side movement by a user. The arm pad covering 205 prevents access to the working components of the arm pad assembly and also provides cushioning for the arm of the user.

The arm pad assembly embodiment shown in FIG. 8 illustrates an arm pad assembly for use with a right chair arm (the link lock release button being in position for easy actuation with the thumb of the user). While only the right arm pad assembly is illustrated herein, it is readily envisioned that a left arm pad assembly would be substantially a mirror image of the illustrated embodiment and is also readily encompassed by the present invention and the description thereof herein.

The arm pad covering 205 is preferably comprised of a synthetic material having favorable properties for use in an arm support embodiment, such as flexibility, durability, and comfort. Accordingly, materials such as vinyl or other synthetic polymers could be used. It is also envisioned, however, that natural materials, such as cotton or wool fabric could be used. The arm pad covering 205 may also include additional materials to increase the padding effect. Suitable materials include cotton stuffing, foam, rubber, gels, plasticized polyurethane gels, and the like. Additionally, in another embodiment, the arm pad covering 205 may comprise a material that is more structurally supportive, such as wood or plastic.

Figure 9:
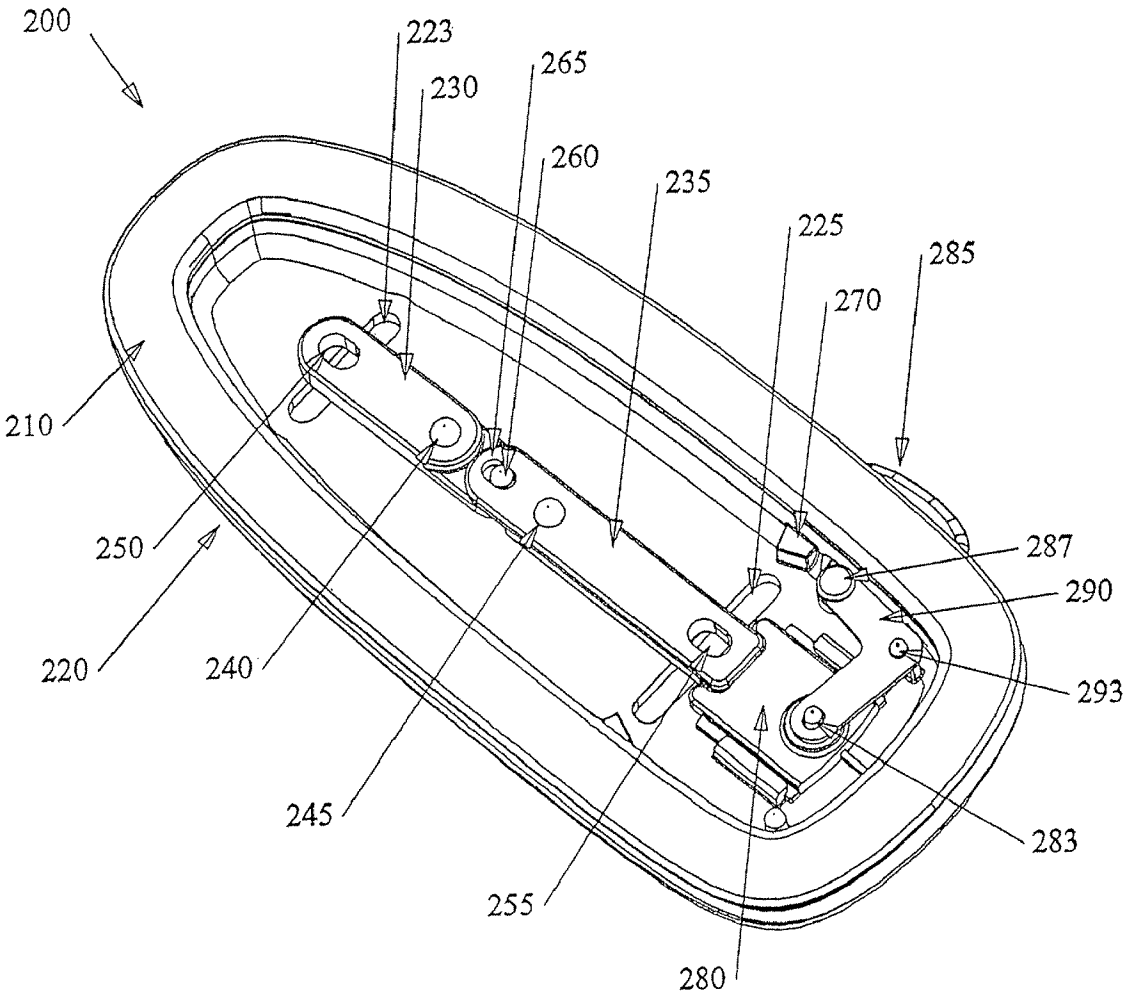
FIG. 9 is a top perspective view of one embodiment of the arm pad assembly according to the invention with the arm pad covering removed.

One embodiment of an arm pad assembly 200 according to the invention is illustrated in FIG. 9, which shows an arm pad assembly 200 with the arm pad covering removed. Shown in this embodiment is an arm pad ring 210 that is attached to the arm pad pan 220, and is useful for facilitating attachment of the arm pad covering to the arm pad pan 220. The arm pad ring 210 is attached to the arm pad pan 220, such as with screws, bolts, rivets, or the like. The arm pad ring 210 comprises a lip extending outward perpendicularly from the top of the arm pad ring 210 and is capable of receiving the arm pad covering 205. Other methods of attaching the arm pad covering 205 to the arm pad pan 220 would be recognizable by one of skill in the art and are also envisioned by the present invention.

In one particular embodiment of the present invention, the arm pad assembly 200 is capable of movement in a horizontal plane. Accordingly, the arm pad assembly 200 is capable of being anchored to a chair arm. Such a chair arm could be fixed in a single vertical position, or the chair arm could be capable of vertical positional adjustment, such as with the arm support assembly 100 of the invention.

The arm pad assembly 200 comprises a rear link 230 and a front link 235 that are attached in a sliding junction. Such attachment can be through any means capable of providing a sliding junction, such as use of a slot and a pin. In one embodiment, the sliding junction is achieved in that the rear link 230 comprises a link connector pin 260, and the front link 235 comprises a link connector slot 265, which is designed for receiving the link connector pin 260. The front link 235 further comprises a slot adapted for receiving a front pivot pin 245, and the rear link 230 further comprises a slot adapted for receiving a rear pivot pin 240. The front pivot pin 245 and the rear pivot pin 240 pivotally attach the front link 235 and the rear link 230, respectively, to the arm pad pan 220. Accordingly, the rear link 230 pivots individually on the rear pivot pin 240, and the front link 235 pivots individually on the front pivot pin 245.

The rear link 230 further comprises a rear attachment slot 250, and the front link 235 further comprises a front attachment slot 255. It is through the rear attachment slot 250 (and necessarily the rear slot track 223 in the arm pad pan 220) and the front attachment slot 255 (and necessarily the front slot track 225) that the arm pad assembly 200 is capable of attachment to a chair arm, such as an arm support assembly 100 of the present invention. For example, the front link 235 can be slidably attached to the front frame block 180 of the arm support assembly 100 through front attachment slot 255, and the rear link 230 can be slidably attached to the rear frame block 185 of the arm support assembly 100 through the rear attachment slot 250. Such attachment can be with screws, bolts, pins, or the like. Preferably, the attachment is secure while still allowing for slidable adjustment of the lateral position of the arm pad assembly 200. Desirably, when such attachment is through the use of screws, a spacer is also used to prevent clamping.

The front link 235 and the rear link 230 are slidably attached to a chair arm in that the attachment passes through a slot track. As shown in FIG. 9, the rear link 230 is slidably attached to an underlying object through the rear slot track 223 formed in the arm pad pan 220, and the front link 235 is slidably attached to an underlying object through the front slot track 225 formed in the arm pad pan 220.

Given the above described configuration, when the arm pad assembly 200 is adjusted in a side-to-side motion, the rear attachment slot 250 and the front attachment slot 255 remain in a constant position in relation to the underlying object to which the arm pad assembly 200 is attached. Such motion causes the front link 235 to pivot at the front pivot pin 245 and causes the rear link 230 to pivot at the rear pivot pin 240. Both the rear pivot pin 240 and the front pivot pin 245 remain in constant position in relation to the arm pad pan 220. As the arm pad assembly 200 is adjusted away from a seated user, the front end of the front link 235 and the rear end of the rear link 230 move toward the seated user, while the rear end of the front link 235 and the front end of the rear link 230 (attached at link connector pin 260) move away from the seated user. When the arm pad assembly 200 is adjusted away from a seated user, such movement is reversed.

The front slot track 225 is greater in length than the rear slot track 223. This disparity in slot track length allows for the arm pad assembly 200 to move in a path that is at least somewhat arcuate in nature. Such arcuate path is further facilitated in that the rear slot attachment 250, the front slot attachment 255, and the link connector slot 265 each have a substantially oblong shape along an axis running from the front to the rear of the arm pad assembly 200. Such oblong shape allows the front slot track 225 and the rear slot track 223 to be substantially linear and still facilitate an arcuate path for the arm pad assembly 200.

The path of lateral adjustment of the arm pad assembly 200 is at least somewhat arcuate in that as the arm pad assembly 200 moves side-to-side, the front link 235 (being at least somewhat longer than the rear link 230) and the front slot track 225 (being at least somewhat longer than the rear slot track 223) allow the front portion of the arm pad assembly 200 to move a greater distance than the rear portion of the arm pad assembly 200. This motion is ergonomically beneficial in that it substantially mimics the natural lateral movement of the forearm portion of a user's arm when the user is in a seated position with arm bent at an approximate 90° angle. For instance, a user in such a seated position wishing to move his or her arm laterally would generally move the distal end of the forearm, or hand, a greater distance than the proximal end of the forearm, or elbow. Thus, with the front portion of the arm pad assembly moving in a path that is at least somewhat arcuate and greater in overall length than the path of the rear portion of the arm pad assembly, a more ergonomically beneficial chair arm rest is provided.

For maintaining a given lateral position of the arm pad assembly (and for allowing for lateral positional adjustment), the arm pad assembly preferably comprises a link-locking mechanism capable of interacting with the front link of the arm pad assembly in a manner that prohibits movement of the front link and rear link. The link-locking mechanism of the invention can take on multiple embodiments capable of engaging the front link.

In one embodiment of the invention, the link-locking mechanism is a lock slide 280, which functions to engage the front link 235, and thereby control lateral adjustment of the arm pad assembly 200. The action by which the lock slide 280 engages the front link 235 is dependent upon the position of the front link 235. According to the embodiment of FIG. 9, the arm pad assembly 200 is incrementally adjustable being capable of achieving five different positional locations within a horizontal plane. Other arrangements allowing for more or less positional locations are also encompassed by the invention.

Figure 9B:
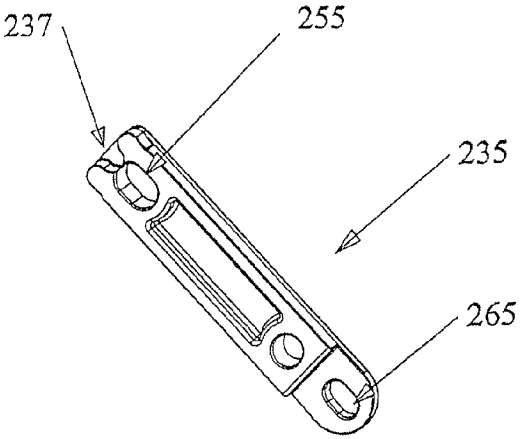
FIG. 9*b* is an enlarged bottom perspective view of the front link mechanism of the arm pad assembly according to the invention.
Figure 9C:
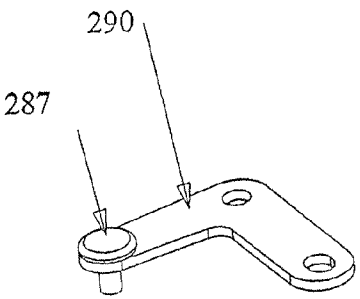
FIG. 9*c* is an enlarged top perspective view of the actuating crank mechanism of the arm pad assembly according to the invention.
Figure 9A:
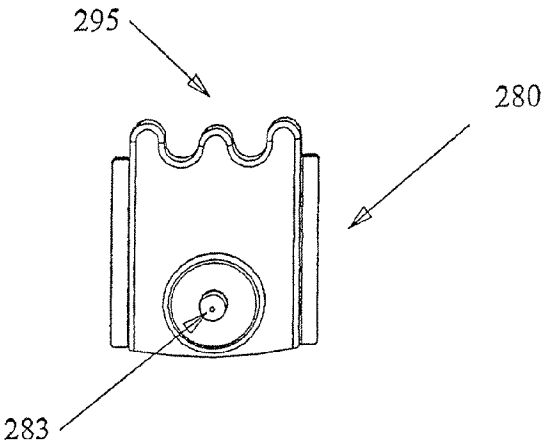
FIG. 9*a* is an enlarged top view of the locks slide mechanism of the arm pad assembly according to the invention.

In one embodiment of the invention, as shown in detail in FIG. 9*a* and FIG. 9*b*, the lock slide 280 comprises three projections, referred to as the lock slide fingers 295. These lock slide fingers 295 are capable of engaging the front link 235 by interacting with front link groove 237, which is visible in FIG. 9*b*, which provides a bottom perspective view of the front link 235. The lock slide 280 is preferably biased into the engaged position (i.e., a position of interaction with the front link 235) and must be manually disengaged prior to positional adjustment of the arm pad assembly 200. Preferentially, the lock slide 280 is biased toward the front link 235 through use of an internal spring (not shown).

Three of the positions achievable by the arm pad assembly 200 in the above described embodiment correspond with the interaction of each of the three lock slide fingers 295 with the front link groove 237. The remaining two positions are an extreme outer position and an extreme inner position, where the front link is completely to the inside or the outside of the lock slide 280. When the arm pad assembly 200 is moved to an extreme outer position away from a seated user, the front link 235 comes into contact with an inner link stop 270. At this point, the lock slide 280 is biased forward, but the lock slide fingers 295 cannot interact with the front link groove 237 as it is to the inside of the lock slide 280. At this position, the front link 235 is locked into position by being secured between the inner link stop 270 and the lock slide 280. Alternately, when the arm pad assembly 200 is moved to an extreme inner position toward a seated user, the front link 235 comes into contact with an outer link stop 275. Again, the front link groove 237 cannot interact with the lock slide fingers 295 because it is to the outside of the lock slide 280. Accordingly, at this position, the front link 235 is locked into position by being secured between the outer link stop 275 and the lock slide 280.

Before manual adjustment of the horizontal position of the arm pad assembly 200 can occur, the lock slide 280 must be moved out of the locked position to allow movement of the front link 235, and thus also the rear link 230, which is connected to the front link 235 at the link connector pin 260. Preferably, the link lock release button 285 is attached to the lock slide 280 such that actuation of the link lock release button 285 moves the lock slide 280 out of engagement with the front link 235.

According to one particular embodiment of the invention, the lock slide 280 can be moved out of connection with the front link 235 by engaging the link lock release button 285. Such actuation is possible in that the link lock release button 285 is connected to the lock slide 280 by an actuating crank 290. As seen in FIG. 9, one end of the actuating crank 290 is attached to the link lock release button 285 with a button pin 287, the other end of the actuating crank 290 is attached to the lock slide 280 at the lock slide pin 283, and the actuating crank 290 is pivotally attached to the arm pad pan 220 at some point in between. One preferred embodiment of the actuating crank 290 is shown in FIG. 9*c*, wherein the actuating crank 290 has an internal angle of approximately 90°, and the actuating crank 290 has an aperture at approximately the angled portion for pivotal attachment to the arm pad pan 220. Other embodiments of the actuating crank 290 would be apparent to one of skill in the art and are also envisioned by the present invention.

Figure 10:
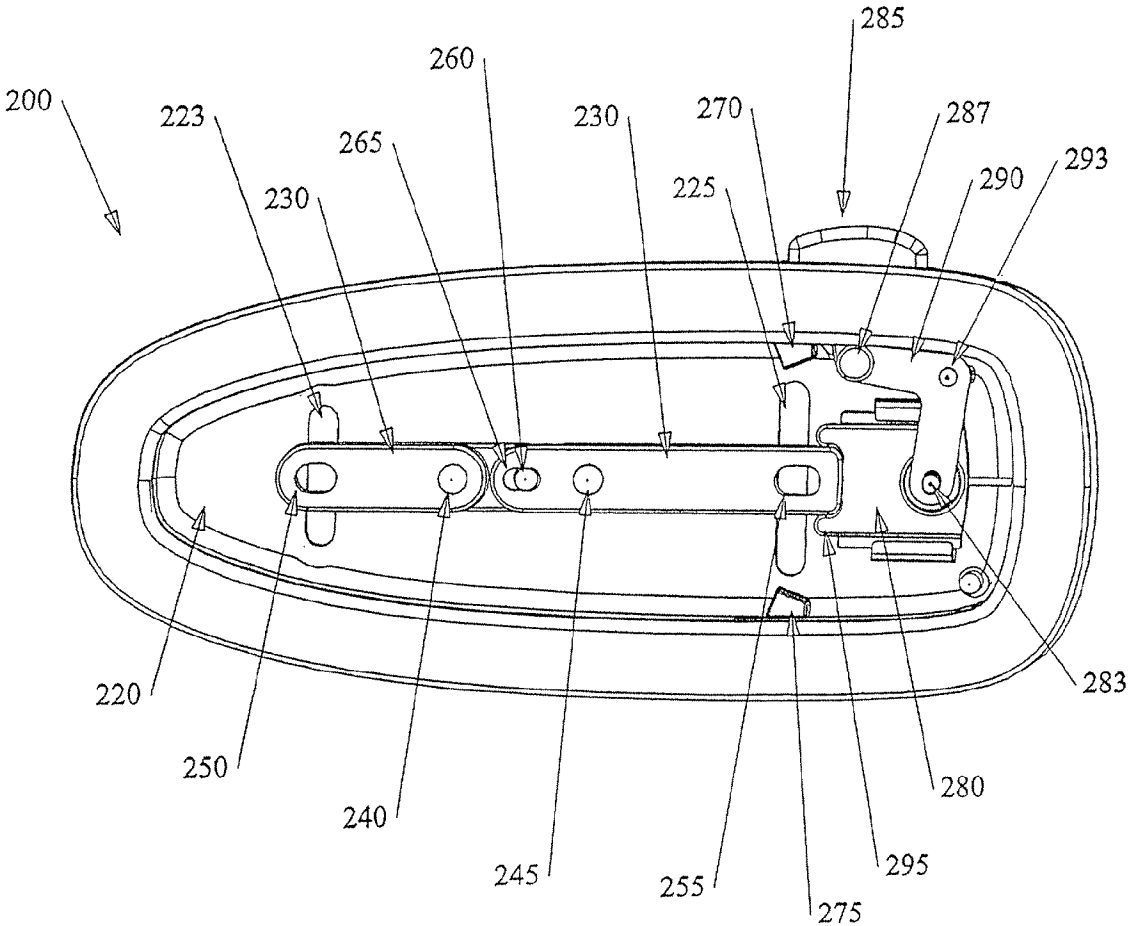
FIG. 10 is a top view of one embodiment of the arm pad assembly according to the invention with the arm pad covering removed and the links engaging the lock slide in the center lock position.
Figure 11:
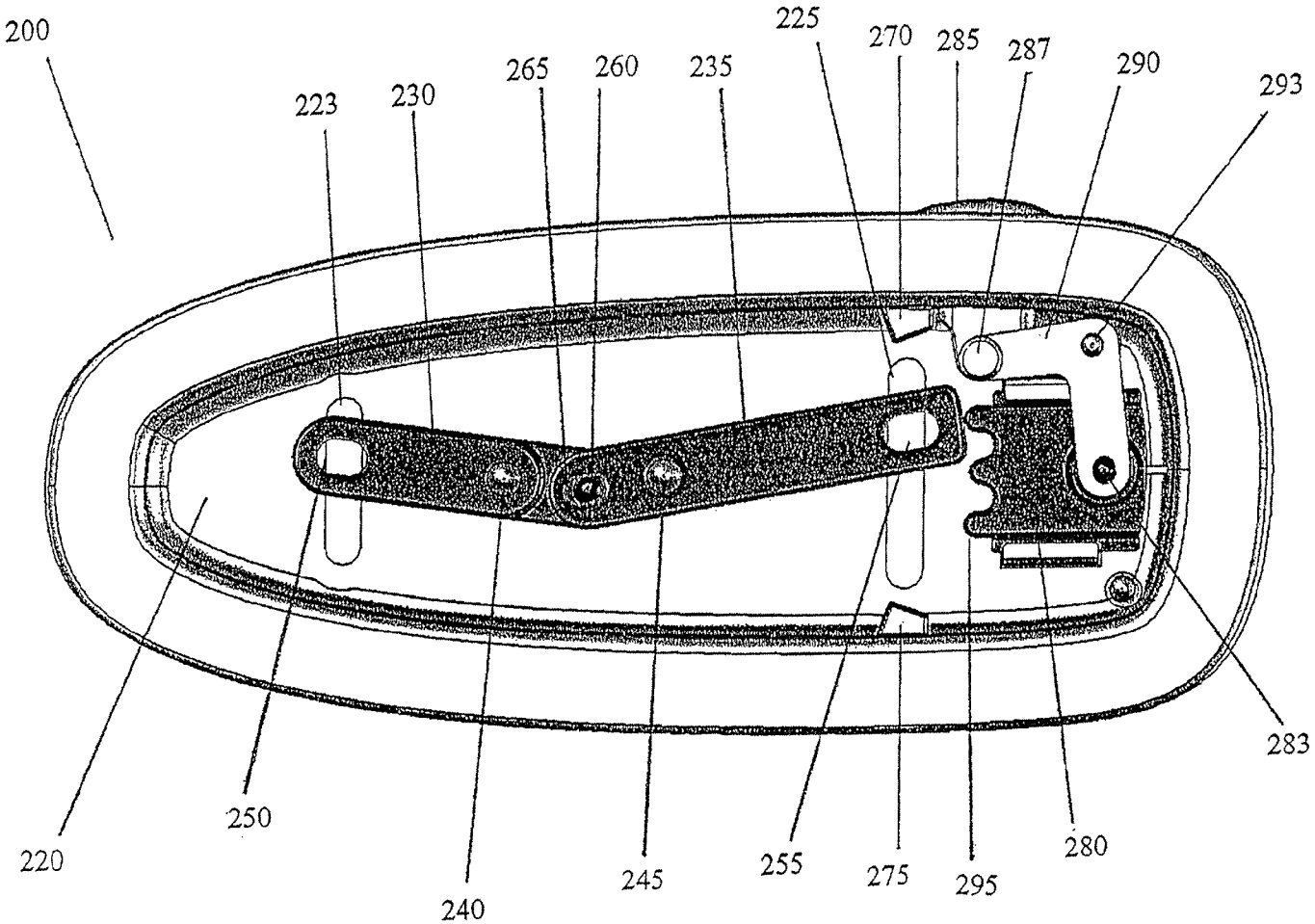
FIG. 11 is a top view of one embodiment of the arm pad assembly according to the invention with the arm pad covering removed and the links disengaged from the lock slide.
Figure 12:
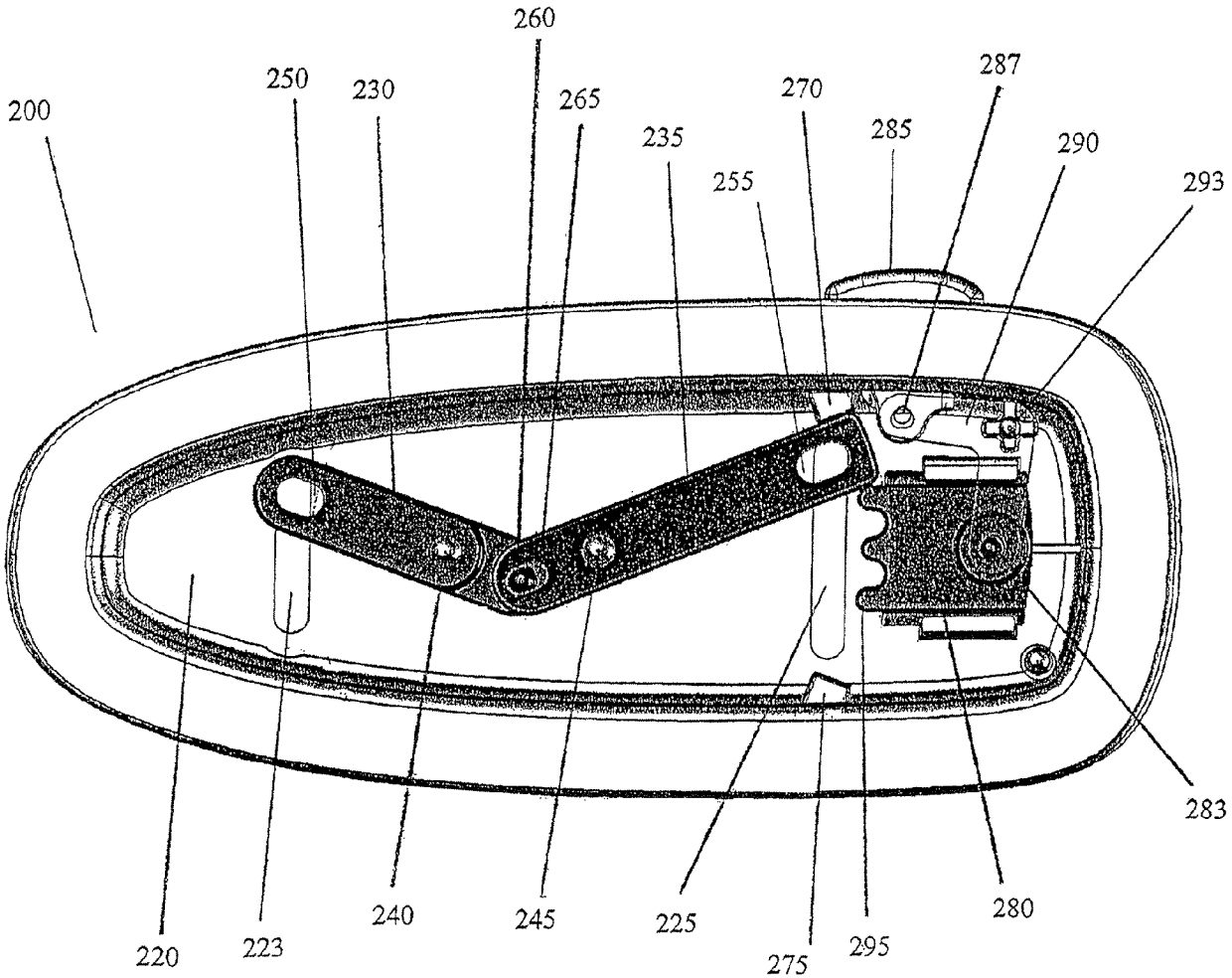
FIG. 12 is a top view of one embodiment of the arm pad assembly according to the invention with the arm pad covering removed and the links engaging the lock slide in the outside lock position.

The ability of the arm pad assembly to be positionally adjustable in a horizontal plane is further illustrated in FIGS. 10-12. FIG. 10 illustrates on embodiment of the arm pad assembly 200 of the invention in a locked position, wherein the adjustable position along a horizontal plane is the middle position. The lock slide 280 is biased toward the front link 235, and the front link groove 237 is engaged by the middle of the three lock slide fingers 295. This can be characterized as the midline position, as the rear link 230, the rear pivot pin 240, the link connector pin 260, the front link 235, the front pivot pin 245, and the lock slide 280 are all substantially aligned along an axis extending from the front of the arm pad assembly 200 to the rear of the arm pad assembly 200.

The arm pad assembly 200, as illustrated in FIGS. 10-12, is preferably formed and arranged to be used with a right arm on a chair. Accordingly, the link lock release button 285 can be easily actuated with the thumb of a seated user.

FIG. 11 illustrates an embodiment of the invention, wherein the arm pad assembly 200 is in an unlocked state and capable of being positionally adjusted in a horizontal plane. As can be seen from the drawing, the link lock release button 285 is actuated inward, and through attachment with the button pin 287, the actuating crank 290 is caused to pivot at the crank pivot 293. Such action causes the lock slide 280 to be moved away from the front link 235, and the lock slide fingers 295 are disengaged from the front link groove 237.

In FIG. 11, the arm pad assembly 200 has been positionally adjusted away from a seated user (in comparison to FIG. 10). Accordingly, the front link 235 has pivoted at the front pivot pin 245, and the rear link 230 has pivoted at the rear pivot pin 240. The front end of the front link 235 and the rear end of the rear link 230 appear to have moved toward the inside of the arm pad pan 220; however, as the front link 235 and the rear link 230 are attached to an underlying object, preferably a chair arm, through the front attachment slot 255 and the rear attachment slot 250, respectively, in actual practice, the inside of the arm pad pan 220 has moved toward the front end of the front link 235 and the rear end of the rear link 230 as the arm pad pan 220 moves along the front slot track 225 and the rear slot track 223. As the front link 235 and the rear link 230 are interconnected at the link connector pin 260, the pivoting action at the front pivot pin 245 and the rear pivot pin 240 causes the rear end of the front link 235 and the front end of the rear link 230 to uniformly move toward the outside of the arm pad pan 220.

As illustrated in FIG. 12, the arm pad assembly 200 has resumed a locked position, positionally adjusted to the extreme outer position relative to a seated user. Accordingly, manual pressure has been relieved from the link lock release button 285, and the biasing action of the lock slide 280 has moved the lock slide 280 toward the front link 235, physically engaging the front link 235. Additionally, the biasing action of the lock slide 280 has caused reverse actuation of the actuating crank 290, which, being attached to the link lock release button 285 through the button pin 287, has caused the link lock release button 285 to return to its undepressed position. Being in the extreme outer position relative to a seated user, the arm pad pan 220 has moved to the extreme inner position of the front slot track 225 and the rear slot track 223. As the front link 235 is attached to an underlying object through the front attachment slot 255, which attaches through the front slot track 225, the front end of the front link 235 is at the extreme inner position of the arm pad pan 220. The front link 235 is locked into this position by physical contact with the inside link stop 270 and the inside finger of the lock slide 280. In this position, the front link groove 237 does not participate in locking the arm pad assembly 200 in place. Rather, the front link 235 is "trapped" between the inside link stop 270 and the lock slide 280.

According to another aspect of the present invention, there is provided an ergonomic office chair having a chair arm that is adjustable in at least one of a vertical plane and a horizontal plane. In one particular embodiment according to this aspect of the invention, there is provided a chair, such as an office chair, comprising an arm support assembly as described herein. In another particular embodiment, a chair is provided comprising an arm pad assembly according to the present invention. In yet another embodiment, a chair according to the present invention comprises an arm support assembly and an arm pad assembly as described herein.

Chairs according to the invention preferentially comprise further components. For example, a chair according to the invention could comprise a pedestal, such as one having a plurality of outwardly extending support arms. Such support arms could further comprise components for facilitating movement of the chair, such as casters. Preferentially, the pedestal includes a height adjustment mechanism. In one particular embodiment, the height adjustment mechanism is a gas spring. The pedestal could further comprise a base attached thereto capable of supporting and having attached thereto additional chair components. For example, a back rest could be pivotally connected to the base, such as through a pivot connecting member extending upward from the base. Further, the base could support a chair seat. Chair arms according to the invention could be attached to the chair in a variety of positions. For example, the chair arms could be attached to the back rest. Alternately, the chair arms could be attached directly to the base. Such chairs could also include swivel components.

Figure 13:
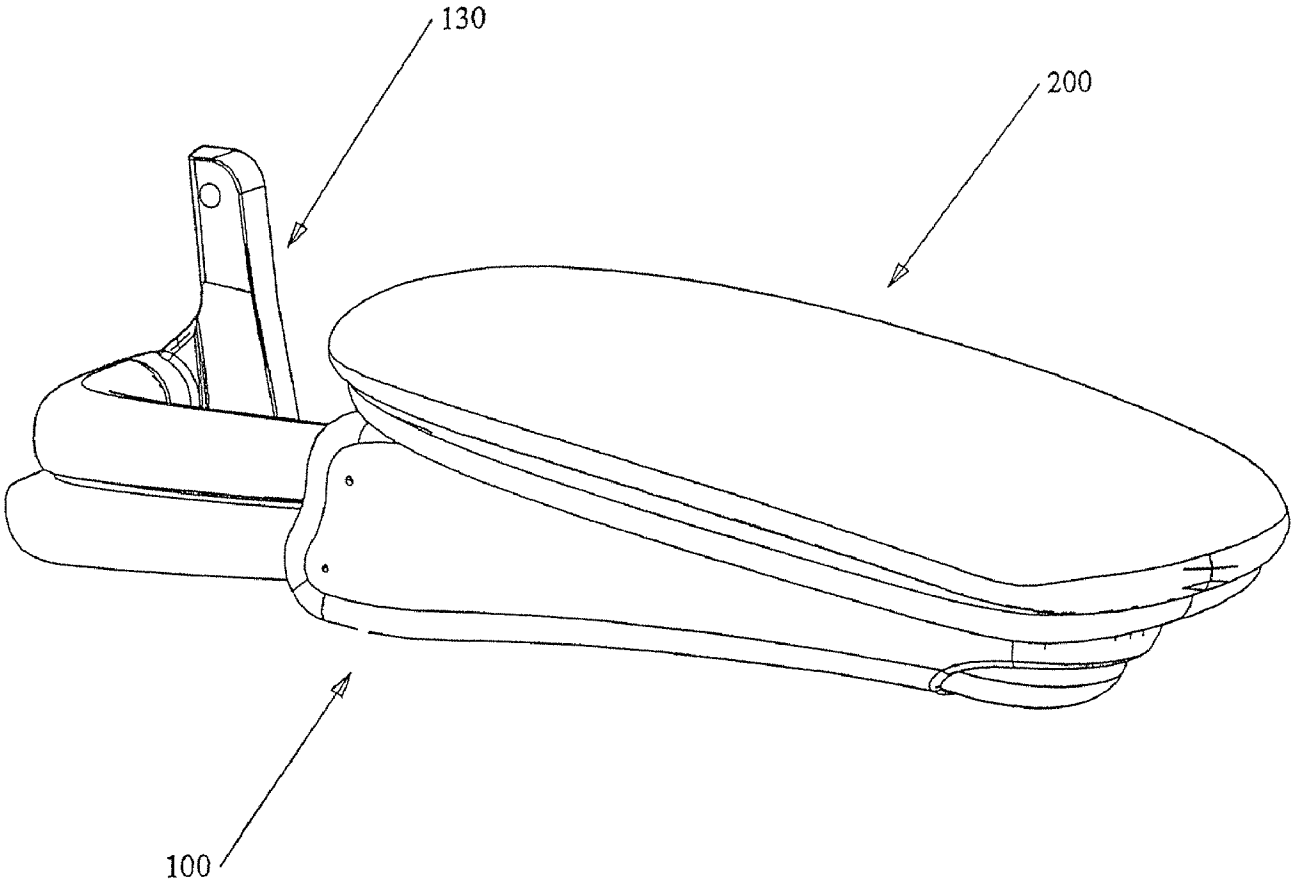
FIG. 13 is a perspective view of one embodiment of a chair arm according to the invention wherein the arm pad assembly is attached to the arm support assembly.

FIG. 13 provides a perspective view of another particular embodiment of the present invention wherein an arm pad assembly 200 is attached to an arm support assembly 100, the combined assembly being capable of attachment to a chair or chair component through the arm mount 130.

Many modifications and other embodiments of the inventions set forth herein will come to mind to one skilled in the art to which these inventions pertain having the benefit of the teaching presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A chair arm pad assembly comprising:
a. an arm pad pan;
b. a front link connected to said arm pad pan;
c. a rear link connected to said arm pad pan;
d. a link locking mechanism releasably engaged to said front link;
e. a link lock release button operably engaged to said link locking mechanism; and
f. wherein said arm pad pan comprises a front slot track and a rear slot track.

2. The chair arm pad assembly of claim 1, wherein said front link and said rear link are attached in a sliding junction.

3. The chair arm pad assembly of claim 1, wherein said front link and said rear link are slidably attached to an underlying object.

4. The chair arm pad assembly of claim 3, wherein the arm pad assembly is capable of moving in the horizontal plain relative to the underlying object.

5. The chair arm pad assembly of claim 1, wherein the length of said front slot track is greater than the length of said rear slot track.

6. The chair arm pad assembly of claim 1, wherein said link locking mechanism comprises a plurality of fingers capable of interacting with said front link.

7. The chair arm pad assembly of claim 1, wherein said link lock release button is pivotally attached to said link locking mechanism.

8. The chair arm pad assembly of claim 7, wherein said pivotal attachment is through an actuating crank.

9. The chair arm pad assembly of claim 1, wherein said front link and said rear link are pivotally attached to said arm pad pan.

10. The chair arm pad assembly of claim 1, wherein said link lock release button is attached to said link locking mechanism such that actuation of said link lock release button moves said link locking mechanism out of engagement with said front link.

11. The chair arm pad assembly of claim 1, wherein said link locking mechanism further comprises a biasing mechanism for urging said link locking mechanism into engagement with said front link.

12. The chair arm pad assembly of claim 1, further comprising an arm pad covering.

13. A chair arm pad assembly comprising:
a. an arm pad pan;
b. a front link connected to said arm pad pan;
c. a rear link connected to said arm pad pan;
d. a link locking mechanism capable of interacting with said front link;
e. a link lock release button operably engaged to said link locking mechanism; and
f. wherein said arm pad pan comprises a front slot track and a rear slot track.

14. The chair arm pad assembly of claim 13, wherein the length of said front slot track is greater than the length of said rear slot track.

15. The chair arm pad assembly of claim 13, wherein said front link is connected to an underlying object through said front slot track and said rear link is connected to said underlying object through said rear slot track.

16. The chair arm pad assembly of claim 13, wherein said front link and said rear link are attached in a sliding junction.

17. The chair arm pad assembly of claim 13, wherein said link locking mechanism further comprises a biasing mechanism for urging said link locking mechanism into engagement with said front link.

18. A chair arm pad assembly comprising:
a. an arm pad pan;
b. a front link connected to said arm pad pan;
c. a rear link connected to said arm pad pan;
d. a link locking mechanism capable of interacting with said front link;
e. a link lock release button operably engaged to said link locking mechanism; and
f. wherein said link locking mechanism comprises a plurality of fingers capable of interacting with said front link.

19. The chair arm pad assembly of claim 18, wherein said front link and said rear link are attached in a sliding junction.

20. The chair arm pad assembly of claim 18, wherein said arm pad pan comprises a front slot track and a rear slot track.

* * * * *